US005510232A

United States Patent [19]

O'Toole

[11] Patent Number: 5,510,232

[45] Date of Patent: Apr. 23, 1996

[54] PHOTOGRAPHIC PROCESSING COMPOSITION AND METHOD USING CATIONIC HYDROQUINONE AS ORGANIC CATALYST FOR PERSULFATE BLEACHING AGENT

[75] Inventor: Terrence R. O'Toole, Webster, N.Y.

[73] Assignee: Eastman Kodak Company, Rochester, N.Y.

[21] Appl. No.: 362,375

[22] Filed: Dec. 22, 1994

[51] Int. Cl.[6] ..... G03C 7/42

[52] U.S. Cl. ..... 430/430; 430/357; 430/372; 430/393; 430/427; 430/429; 430/461

[58] Field of Search ..... 430/393, 427, 430/430, 461, 357, 372, 429

[56] References Cited

U.S. PATENT DOCUMENTS

| | | | |
|---|---|---|---|
| 3,707,374 | 12/1972 | VanDerVorn et al. | 430/430 |
| 3,748,136 | 7/1973 | Willems et al. | 430/427 |
| 3,870,520 | 3/1975 | Shimamura et al. | 430/418 |
| 4,292,401 | 9/1981 | Itoh et al. | 430/393 |
| 4,508,816 | 4/1985 | Yamamuro et al. | 430/393 |
| 4,508,817 | 4/1985 | Ohno et al. | 430/393 |
| 4,524,129 | 6/1985 | Kishimoto et al. | 430/393 |
| 4,578,345 | 3/1986 | Ohno et al. | 430/393 |

FOREIGN PATENT DOCUMENTS

| | | |
|---|---|---|
| 141727 | 3/1979 | German Dem. Rep. . |
| 3234467 | 10/1981 | Germany . |

*Primary Examiner*—Hoa Van Le
*Attorney, Agent, or Firm*—J. Lanny Tucker

[57] ABSTRACT

Certain cationic hydroquinones are useful catalysts for persulfate bleaching agents in photographic processing methods. These compounds are oxidizable by persulfate and reducible by silver metal at a pH of from 1 to 7, and have a chemically reversible redox couple of from about −0.20 to about +1.5 volts. The persulate bleaching ability is enhanced by the presence of these compounds which are used in a step prior to bleaching.

14 Claims, No Drawings

PHOTOGRAPHIC PROCESSING COMPOSITION AND METHOD USING CATIONIC HYDROQUINONE AS ORGANIC CATALYST FOR PERSULFATE BLEACHING AGENT

FIELD OF THE INVENTION

The present invention relates generally to the processing of photographic elements. More particularly, it relates to the use of certain cationic organic compounds as catalysts for persulfate bleaching agents. The solutions containing these organic compounds and methods for their use in photography are the subject of this invention.

BACKGROUND OF THE INVENTION

During processing of silver halide photographic elements, the developer is oxidized to a silver salt by a suitable bleaching agent. The oxidized silver is then removed from the element in a "fixing" step.

The most common bleaching solutions contain complexes of ferric ion and various organic ligands. One primary desire in this industry is to design bleaching compositions which are more compatible with the environment, and thus it is desirable to reduce or avoid the use of ferric ions and many of the common complexing ligands.

Persulfate bleaching solutions offer an alternative to the ferric complex bleaching solutions. However, persulfate bleaching agents are slow in bleaching performance unless they are used with bleach accelerators. Most commonly used accelerators are thiols which often have objectionable odors and are unstable when incorporated directly into bleaching solutions.

Other accelerators are known. For example, U.S. Pat No. 3,748,136 (Willems) describes the use of aromatic amines to catalyze persulfate bleaching agents. Two other publications, DD 0141727 and DE 3,234,467, describe the presence of a quinone in persulfate bleaches, and optionally the presence of cupric ion. The inherent stability of these catalysts in the presence of persulfate, however, is poor.

There remains a need, therefore, for highly efficient persulfate bleaching solutions which do not suffer from the problems noted above, that is, they are rehalogenating, stable and useful for a variety of photographic elements, and lack objectionable odors.

SUMMARY OF THE INVENTION

The present invention overcomes the problems noted above with a method for processing a photographic element comprising:

A) treating an imagewise exposed and developed photographic element with a solution comprising at least about 0.0005 mol/l of a cationic hydroquinone which has the following properties:

a) a reduced form which is oxidizable by a persulfate at a pH of from about 1 to about 7, b) an oxidized form which is reducible by silver metal in the presence of bromide or chloride at a pH of from about 1 to about 7, c) a chemically reversible redox couple, versus a saturated calomel electrode, of from about −0.20 to about +1.5 volts, and d) is represented by structure (I) or (II):

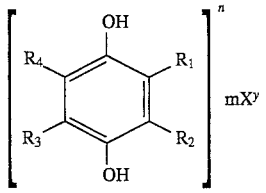

(I)

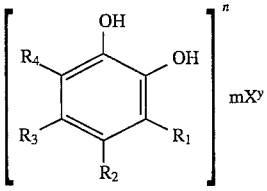

(II)

wherein $R_1$, $R_2$, $R_3$ and $R_4$ are independently hydrogen, halo, nitro, sulfonate, phosphonate, amide, sulfonamide, carboxyl, hydroxy, an ester, an ether, a primary, secondary or tertiary amine, an alkyl group of 1 to 12 carbon atoms, an aryl group of 6 to 12 carbon atoms in the ring structure, a cycloalkyl group of 5 to 12 carbon atoms in the ring structure, or a quaternized aliphatic or aromatic amine or imine, or any two adjacent groups chosen from $R_1$, $R_2$, $R_3$ and $R_4$, can represent the carbon, nitrogen, oxygen and sulfur atoms necessary to complete a 5- to 12-membered fused carbocyclic or heterocyclic ring structure connected to the primary nucleus of structure (I) and (II), provided at least one of $R_1$, $R_2$, $R_3$ and $R_4$ is a quaternized aliphatic or aromatic amine or imine, or at least one ring structure formed from adjacent groups contains a quaternized amine or imine moiety, X is an anion, m is the absolute value of the ratio of n to y, n is 1 to 3, and y is a negative integer having an absolute value of 1 to 3, and B) bleaching the treated element with a persulfate bleaching solution.

The present invention also provides a photographic processing solution having a pH of from about 1 to about 7 and comprising at least about 0.0005 mol/l of the cationic hydroquinone described above, and a transition metal ion having an oxidation state of (II) or (III), the solution being free of a bleaching agent.

The method of this invention provides rapid and efficient bleaching of the imagewise exposed and developed photographic elements and avoids the problems noted above with known methods. The specific cationic hydroquinones described herein effectively catalyze the persulfate bleaching action without being in the bleaching solution. The cationic hydroquinones are used in processing baths prior to bleaching so their stability is preserved.

These advantages are possible with the use of the particular cationic hydroquinones which have certain properties: (1) a reduced form which is oxidizable by a persulfate at a pH of from about 1 to about 7, (2) an oxidized form reducible by silver metal in the presence of bromide or chloride at the same pH, (3) a chemically reversible redox couple of from about −0.20 to about +1.5 volts, and (4) the structure (I) or (II) described herein. At least about 0.0005 mol/l of the cationic hydroquinone is used in the processing solution.

DETAILED DESCRIPTION OF THE INVENTION

The cationic hydroquinones useful as catalysts for the persulfate bleaching agents in the practice of this invention have a chemically reversible redox couple between about −0.20 and about +1.5 volts, as measured against a saturated calomel electrode. Preferably, the redox couple is from about −0.02 to about +1 volt.

The hydroquinones have a net positive charge, and thus have a corresponding anion which can be a halide (such as bromide, chloride or iodide), sulfate, sulfite, carbonate, nitrate, nitrite, phosphate, phosphite, carboxylate, sulfonate, phosphonate or another anion which would be readily apparent to one skilled in the art.

Positive charges in the molecule can be provided by pendant positively charged monovalent groups attached to the hydroquinone ring, or they can be provided by quaternized amine or imine moieties within the molecule ring structure formed from the hydroquinone nucleus and suitable fused rings represented by adjacent $R_1$, $R_2$, $R_3$ and $R_4$ groups.

The hydroquinones are represented by one of the following structures (I) and (II):

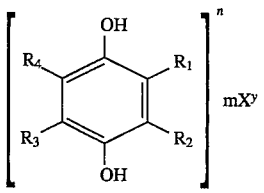

(I)

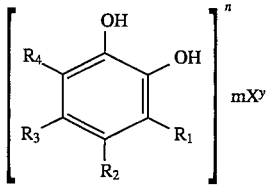

(II)

Structures (I) and (II) can also exist in their oxidized forms wherein the hydroxy group is oxidized to an oxo group.

In the foregoing structures, $R_1$, $R_2$, $R_3$ and $R_4$ are independently hydrogen, halo (such as chloro, bromo and iodo), nitro, sulfonate, phosphonate, amide, sulfonamide, carboxyl, hydroxy, an ester (such as acetate and benzoate), an ether, a primary, secondary or tertiary amino (for example, an amine substituted with a linear or branched, substituted or unsubstituted alkyl group of 1 to 12 carbon atoms (as described above), a linear or branched, substituted or unsubstituted alkyl group of 1 to 12 carbon atoms (as described above), a substituted or unsubstituted aryl group of 6 to 12 carbon atoms in the ring structure (such as phenyl, tolyl, xylyl, naphthyl and anthryl), a substituted or unsubstituted cycloalkyl group of 5 to 12 carbon atoms in the ring structure (such as cyclopentyl, cyclohexyl and 4-methylcyclohexyl) or a quaternized aliphatic or aromatic amine or imine.

The term "ring structure" is meant to refer to one or more fused rings in the same molecule.

Preferably, at least one of $R_1$, $R_2$, $R_3$ and $R_4$ is a quaternized aliphatic or aromatic amine or imine. Such amines and imines can be represented by either the structures (III) and (IV):

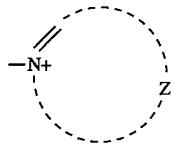

III

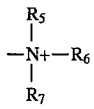

IV wherein Z represents the carbon, oxygen, nitrogen and sulfur atoms necessary to complete a substituted or unsubstituted 5- to 12-membered aromatic ring structure including, but not limited to, a pyridyl, pyrimidinyl, pyrazinyl, pyridizinyl, quinolinyl, quinoxalinyl, azonyl, thiazolyl, isopyrrolyl, pyrazolyl, imidazolyl, oxazolyl, isoxazolyl, oxadiazolyl, oxatriazolyl, dioxazolyl, triazinyl, oxazinyl, oxathiazinyl, diazepinyl, indolyl, isodinazolyl, quinolyl, isoquinolyl, indoxazinyl, quinazolinyl, pyridopyridyl, cinnolinyl, benzoxazinyl, pteridinyl, quinolinyl, pyrrolyl, thiopenyl, pyranyl and furazanyl ring.

$R_5$, $R_6$ and $R_7$ are independently a linear or branched, substituted or unsubstituted alkyl group of 1 to 12 atoms (as defined above), or a substituted or unsubstituted cycloalkyl group of 5 to 12 carbon atoms in the ring structure (as defined above).

Alternatively, any two adjacent groups chosen from $R_1$, $R_2$, $R_3$, and $R_4$, can represent the carbon, nitrogen, oxygen and sulfur atoms necessary to complete a substituted or unsubstituted 5- to 12-membered fused carbocyclic or heterocyclic ring structure connected to the primary nucleus of structures (I) or (II). Representative carbocyclic and heterocyclic ring structures are described above, but others include thiophenyl, furanyl, pyronyl, dioxinyl, oxazinyl, pyranyl, dioxazolyl and cyclohexenyl. It should be understood that such ring structures can have one or more positive charges provided by cyclic quaternary amine or imines and can be substituted with one or more monovalent groups described above in defining $R_1$ through $R_4$.

In the foregoing structures, X is an anion as described above, m is the absolute value of the ratio of "n" to "y", n is 1 to 3, and y is a negative integer having an absolute value of 1 to 3.

Particular compounds useful herein as catalysts include, but are not limited to, 5,8-dihydroxy-4a-azoniaanthracene bromide (Compound 1), 5,6-dihydroxy-4a-azoniaanthracene bromide (Compound 2), N-(2,5-dihydroxyphenyl)pyridinium chloride (Compound 3), N-[methyl(2,5-dihydroxy-4-methylphenyl)]pyridinium chloride (Compound 4), N-[methyl(2,5-dihydroxy-4-methyl)]isoquinolinium chloride (Compound 5), N-[(methyl(2,5-dihydroxy-4-methyl)]quinolinium chloride (Compound 6), 2,5-dihydroxyphenyltrimethylammonium chloride (Compound 7). Compound 1 is most preferred.

In the most general sense, the amount of hydroquinone catalyst present in the solution is at least about 0.0005 mol/l. From about 0.0005 to about 0.1 mol/l is preferred, and from about 0.001 to about 0.01 mol/l is more preferred. A mixture of the described cationic hydroquinones can be used if desired, as long as they do not interfere with each other in any way, for example, diminish the catalytic effect or cause precipitation.

The solution containing the cationic hydroquinone can have a pH of from about 1 to about 7. The preferred pH is in the range of from about 3 to about 5. Various buffers may be present to maintain a desired pH in amounts which would be readily apparent to one skilled in the art. Such materials include, but are not limited to, organic or inorganic monobasic, dibasic and tribasic acids or protonated amine having at least one pKa between 1 and 9. Specifically useful buffers include acetate, 2-methylacetate, maleate, glycolate, succinate, imidazole, 3-morpholino-2-hydroxypropane, 4-sulfophthalate, trimellitate, bisulfate and dihydrogen phosphate. Mixtures of buffers can also be used. Buffer counterions may include sodium, potassium, ammonium and tetraalkylammonium ions among others readily apparent to one skilled in the art. The amount of buffer used is generally from about 0.01 to about 2 mol/l, with from about 0.05 to about 1 mol/l being preferred.

The cationic hydroquinones useful herein as catalysts can be prepared using procedures either known from the literature or readily apparent to one skilled in the art using conventional starting materials.

Besides prebath solutions, the cationic hydroquinone can be included in what are known as developer "stop" solutions having a pH of from about 1 to about 7 (preferably from about 1 to about 5). One or more suitable buffers (such as acetate or bisulfate) are included at a concentration of from about 0.1 to about 4 mol/l (preferably from about 0.2 to about 2 mol/l). Such solutions can also include a transition metal ion co-catalyst (described below).

The solution containing the cationic hydroquinone does not contain a bleaching agent of any kind, and is particularly free of persulfate bleaching agents, so the cationic hydroquinone has optimal stability.

As noted above, the cationic hydroquinone catalyst is used prior to bleaching with a persulfate bleaching solution. Such bleaching solutions contain a conventional persulfate bleaching agent, having an appropriate counterion including, but not limited to, alkali and alkaline earth salts, and ammonium. Examples of such bleaching solutions are well known and described, for example, in *Research Disclosure*, publication 36544, pages 501–541 (September, 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

Especially preferred bleaching solutions are those containing sodium persulfate.

The amounts of bleaching agents used in such solutions are well known in the art. For example, the amount of persulfate is generally from about 0.02 to about 2 mol/l, and preferably from about 0.05 to about 1 mol/l.

The persulfate bleaching solution can also comprise one or more rehalogenating agents, such as a halide (for example, chloride or bromide). The rehalogenating agent is generally present in an amount of from about 0.02 to about 2 mol/l with from about 0.05 to about 0.5 mol/l being more preferred. Any acceptable counterion can be used with the rehalogenating agent. Ammonium is preferred for water solubility, but potassium or sodium may also be desirable for environmental reasons.

The bleaching solution can also be what is known in the art as a silver-retentive bleaching solution which generates a water-insoluble silver salt other than silver halide, as described for example in U.S. Pat. No. 4,454,224 (Brien et al).

Other addenda commonly added to bleaching solutions can also be included, such as corrosion inhibitors, optical whitening agents, defoaming agents, calcium chelating agents, halogen scavengers, radical scavengers and other materials readily apparent to one skilled in the art. The compositions can be formulated as a working bleaching solutions, solution concentrates or as dry powders or tablets.

It is particularly desirable that the bleach solution or the solution containing the hydroquinone catalyst also contain a transition metal ion as a co-catalyst. Such ions generally have a metal oxidation state of (II) or (III), and can be provided in the form of conventional inorganic salts, or as organic salts or complexes (such as amine and diimine complexes), many of which are readily available from commercial sources or prepared using known procedures.

Generally, such transition metal ions are first row metals of the Periodic Table. Preferably, they include, but are not limited to, copper(II), iron(II), iron(III), cobalt(II) or nickel(II), or their complexes, which can be supplied in any suitable salt. Copper(II) is most preferred. It can be supplied, for example, as part of an inorganic salt or as a copper(II) diimine ligand complex such as those described, for example, in copending and commonly assigned U.S. Ser. No. 08/363,106, filed on even date herewith by O'Toole et al, and entitled "Processing of Photographic Elements Using Copper Ligand Complexes to Catalyze Peracid Bleaching Agents".

The amount of the transition metal ion used in the practice of this invention is at least about 0.0001 mol/l, preferably from about 0.0001 to about 0.01 mol/l, and more preferably from about 0.0005 to about 0.005 mol/l. The amounts may vary with the particular transition metal ion, cationic hydroquinone and bleaching agent used.

In yet another embodiment, a fixing step can precede use of the cationic hydroquinone.

There can optionally be an intermediate wash step between the use of a prebath or developer stop solution containing the cationic hydroquinone catalyst and bleaching step. The wash solution can be merely water, or a suitable acidic rinse comprising one or more weak or strong acids which would be readily known to one skilled in the art.

The operating temperature for using the prebath solution containing the cationic hydroquinone catalyst is generally from about 10° to about 50° C., and preferably from about 25° to about 40° C.

As used herein, in defining amounts of materials, the term "about" refers to ±20% of the indicated value. In defining pH, it refers to ±0.5 pH unit, and in defining temperature, it refers to ±5° C. In defining the term redox potential, it refers to ±0.2 volt.

Conventional fixing solutions can be used at an appropriate time in the processing of the elements. Such solutions contain fixing agents, such as thiosulfates, thioethers, thiocyanates, amines, mercapto-containing compounds, thiones, thioureas, iodides, and others which would be readily apparent to one skilled in the art. Particularly useful fixing agents include, but are not limited to, ammonium thiosulfate, sodium thiosulfate, potassium thiosulfate, guanidine thiosulfate, and various thioethers. Useful and optimum amounts of fixing agents would be readily apparent to one skilled in the art, and are generally from about 0.1 to about 3 mol/l.

The fixing solution can also contain a preservative such as a sulfite, for example, ammonium sulfite, a bisulfite or a metabisulfite salt, or a fixing accelerator.

If desired, the cationic hydroquinones described herein can be recovered using conventional ion exchange resins and procedures after their use in processing photographic elements.

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be used as well as conventional supports.

Considerably more details of the element structure and components, and suitable methods of processing various types of elements are described in *Research Disclosure*, noted above. All types of emulsions can be used in the elements, including but not limited to, thin tabular grain emulsions, and either positive-working or negative-working emulsions. The elements can be either photographic film or paper elements.

The elements are typically exposed to suitable radiation to form a latent image and then processed to form a visible dye image. Processing includes the step of color development in the presence of a color developing agent to reduce developable silver halide and to oxidize the color developing agent. Oxidized color developing agent in turn reacts with a color-forming coupler to yield a dye.

Development is then followed by the use of a solution containing a cationic hydroquinone catalyst as described herein. The bleaching and fixing steps can be carried out in any suitable fashion, as is known in the art. Subsequent to bleaching and fixing, a final washing or stabilizing step may be employed. Color prints and films can be processed using a wide variety of processing protocols, as described for example, in *Research Disclosure*, noted above.

The following examples are presented to illustrate the practice of this invention, and are not intended to be limiting in any way. Unless otherwise indicated, all percentages are by weight.

EXAMPLES 1–7:

USE Of CATALYSTS IN PTRBATH SOLUTIONS WITH PERSULFATE BLEACHING

Several compositions (or solutions) of this invention were compared to several Control solutions outside the scope of this invention to evaluate the catalytic effect of the several cationic hydroquinone catalytic compounds described herein.

Samples of KODAK GOLD PLUS™ 100 photographic film were exposed 0.5 second with 5500K illumination and processed using the following protocol to yield 1.24 g/m$^2$ of developed silver metal:

| | |
|---|---|
| 3.25 minutes | Development* |
| 1 minute | Stop solution (1% v/v $H_2SO_4$) |
| 1 minute | Water wash |
| 4 minutes | Fixing** |
| 3 minutes | Water wash |
| 1 minute | KODAK PHOTO-FLO ™ rinse |
| 5 minutes | Dry |

*The developing solution (per liter) was an aqueous solution of potassium carbonate (34.3 g), potassium hydrogen carbonate (2.3 g), sodium sulfate (3.7 g), potassium iodide (1.2 mg), sodium bromide (1.3 g), diethylenetriamine-pentaacetic acid (40% w/w, 8.4 g), hydroxylamine sulfate (2.4 g) and KODAK ™ TM Color Developing Agent CD4 (4.5 g), and had a pH of 10.05.
**The fixing solution (per liter) was an aqueous solution of sodium metabisulfite (11.8 g) and a solution (162 ml) of ammonium thiosulfate (56.5%) and ammonium sulfite (4%), and had a pH of 6.5. KODAK PHOTO-FLO ™ is a commercially available rinse.

For the following experiments (both the Invention and Controls), the developed film samples were mounted in an optically transparent cell which was fitted within a conventional UV/visible spectrophotometer. As the bleaching solution was passed over the film sample, the loss in optical density was monitored at 820 nm and 25° C. The loss in optical density is directly related to the bleaching of silver metal to silver halide.

Bleaching was carried out using a conventional Control A bleaching solution containing sodium persulfate (0.1 mol/l), sodium bromide (0.15 mol/l) and sodium acetate (0.04 mol/l). The pH was adjusted to 3.7 with acetic acid (0.26 mol/l). When a film sample was processing using the Control A solution, no bleaching occurred even after 500 seconds.

A Control B prebath solution contained hydroquinone (5 mmol/l) in water. The developed film was immersed in the prebath for 1 minute and rinsed in water for 1 minute. When contacted with the Control A bleaching solution, no bleaching occurred after 500 seconds. Simple hydroquinone is not effective as a catalyst in the prebath solution.

In contrast, a prebath solution was used according to this invention (Example 1). The prebath solution was prepared to have Compound 1 (5 mmol/l) in water. The developed film was immersed in the prebath solution for 1 minute and rinsed in water for 1 minute. When contacted with the Control A bleaching solution, bleaching occurred with a $t_{50}$ of 53 seconds ($t_{50}$ is the time for 50% of bleaching to occur).

A Control C bleaching solution was prepared containing sodium persulfate (0.1 mol/l), sodium bromide (0.15 mol/l), copper(II) sulfate, hydrate (0.002 mol/l) and sodium acetate (0.04 mol/l). The pH was adjusted to 3.7 with acetic acid (0.26 mol/l). Bleaching of the developed film was carried out and a $t_{50}$ of 125 seconds was observed.

In Example 2, developed film was bleached as in Example 1 using the Control C solution and a $t_{50}$ of 18 seconds was observed. This bleaching rate is much faster than expected based on the sum of the individual bleaching rates obtained with the use of Compound 1 (Example 1) and the copper(II) co-catalyst alone (Control C). Thus, the combination of the cationic hydroquinone catalyst and the transition metal ion co-catalyst provides an unexpected synergistic catalytic effect. The copper(II) ion does not stabilize the bleaching solution, however.

In Control D, a prebath solution was prepared containing 4a-azoniaanthracene (5 mmol/l) in water. This compound is similar in structure to Compound 1 and is an onium compound within the scope of the teaching of U.S. Pat No. 3,748,136 (noted above). Developed film was immersed in the prebath solution for 1 minute and rinsed with water for 1 minute. When contacted with the Control A bleaching solution, the film was not bleached. When the Control D solution was used for bleaching, the film was bleached very slowly (incomplete after 500 seconds). This demonstrates that it is the quinone group on Compound 1 which is responsible for bleaching catalysis. The azonia nitrogen is not involved in the bleaching reactions, but aids in the adsorption of the molecule to the film in the prebath. This comparison also demonstrates that the teaching of the noted patent does not suggest the use of specific cationic hydroquinones to catalyze persulfate bleaching.

In Example 3, the film was processed as in Example 2 except that the prebath solution contained Compound 3 (5 mmol/l). A $t_{50}$ of 89 seconds was observed.

Similarly, in Example 4, the film was processed using Compound 4 (5 mmol/l) in a prebath solution, and a $t_{50}$ of 56 seconds was observed.

When Compound 6 (5 mmol/l) was used (Example 5), similarly to in Example 4, a $t_{50}$ of 75 seconds was observed.

For Control E, a standard persulfate bleaching solution known as SR-30 was prepared, containing sodium persulfate (0.14 mol/l), sodium chloride (0.26 mol/l) and sodium dihydrogenphosphate (0.075 mol/l). The solution pH was adjusted to 2.2 using phosphoric acid. In a conventional flow cell, the developed film was bleached with SR-30, but no bleaching was observed after 500 seconds.

In Example 6, the bleaching solution of Control E was used, but prior to bleaching, the developed film was contacted with the prebath solution of Example 1 using the same protocol. A $t_{50}$ of 71 seconds was observed.

In Control F, the developed film was processed using conventional C-41, FLEXICOLOR™ Bleach III bleaching solution containing ferric-propylenediaminetetraacetic acid complex as the bleaching agent. A $t_{50}$ of 32 seconds was observed. While this commercially available bleaching solution provides rapid bleaching, the aim of the industry is to find replacements for such bleaching solutions because of environmental concerns.

For Example 7, a development stop solution containing was prepared containing Compound 1 (5 mmol/l) dissolved in acetate buffer (0.3 mol/l total acetate, pH 3.7). The film was step exposed and processed using the following protocol at 37.8° C.:

| | |
|---|---|
| 3.25 minutes | Development (as noted above) |
| 1 minute | Stop solution* |
| 1 minute | Water wash |
| 0–4 minutes | Bleaching (Control C) |
| 3 minutes | Water wash |
| 4 minutes | Fixing (as noted above) |
| 3 minutes | Water wash |
| 1 minute | KODAK PHOTO-FLO ™ rinse |
| 5 minutes | Dry |

*Contains Compound 1.

The results of bleaching, as a function of time as measured by X-ray fluorescence is shown in the following Table I. Bleaching was considered complete when the amount of residual silver was less than 0.076 g/m$^2$.

TABLE I

| BLEACH TIME (SEC) | Ag REMAINING (g/m$^2$) |
|---|---|
| 0 | 1.23 |
| 30 | 0.39 |
| 60 | 0.082 |
| 120 | 0.028 |
| 240 | 0.015 |

The invention has been described in detail with particular reference to preferred embodiments thereof, but it will be understood that variations and modifications can be effected within the spirit and scope of the invention.

I claim:

1. A method for processing a photographic element comprising:

A) treating an imagewise exposed and developed photographic element with a nonbleaching solution comprising at least about 0.0005 mol/l of a cationic hydroquinone which has the following properties:

a) a reduced form which is oxidizable by a persulfate at a pH of from about 1 to about 7, b) an oxidized form which is reducible by silver metal in the presence of bromide or chloride at a pH of from about 1 to about 7, c) a chemically reversible redox couple, versus a saturated calomel electrode, of from about −0.20 to about +1.5 volts, and d) is represented by the structure (I) or (II):

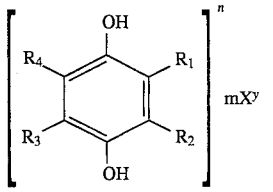

(I)

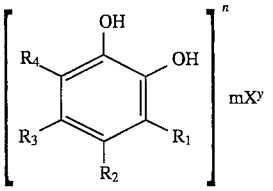

(II)

wherein $R_1$, $R_2$, $R_3$, and $R_4$ are independently hydrogen, halo, nitro, sulfonate, phosphonate, amide, sulfonamide, carboxyl, hydroxy, an ester, an ether, a primary, secondary or tertiary amine, an alkyl group of 1 to 12 carbon atoms, an aryl group of 6 to 12 carbon atoms in the ring structure, a cycloalkyl group of 5 to 12 carbon atoms in the ring structure or a quaternized aliphatic or aromatic amine, or any two adjacent groups chosen from $R_1$, $R_2$, $R_3$ and $R_4$, can represent the carbon, nitrogen, oxygen or sulfur atoms necessary to complete a 5- to 12-membered fused carbocyclic or heterocyclic ring structure connected to the primary nucleus of structure (I) or (II), provided at least one of $R_1$, $R_2$, $R_3$ and $R_4$ is a quaternized aliphatic or aromatic amine, or at least one ring structure formed from adjacent groups contains a quaternized amine or imine moiety, X is an anion, m is the absolute value of the ratio of n to y, n is 1 to 3, y is a negative integer having an absolute value of 1 to 3, and B) bleaching said treated film with a persulfate bleaching solution.

2. The method of claim 1 wherein at least one of $R_1$ through $R_4$ is a quaternized aliphatic or aromatic amine or imine.

3. The method of claim 2 wherein said quaternized aliphatic aromatic amine or imine is represented by either the structures (III) and (IV):

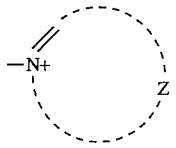

III

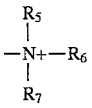

IV wherein Z represents the carbon, oxygen, nitrogen and sulfur atoms necessary to complete a 5- to 12-membered aromatic ring structure which is a pyridyl, pyrimidinyl, pyrazinyl, pyridizinyl, quinolinyl, quinoxalinyl, azonyl, thiazolyl, isopyrrolyl, pyrazolyl, imidazolyl, oxazolyl, isoxazolyl, oxadiazolyl, oxatriazolyl, dioxazolyl, triazinyl, oxazinyl, oxathiazinyl, diazepinyl, indolyl, isodinazolyl, quinolyl, isoquinolyl, indoxazinyl, quinazolinyl, pyridopyridyl, cinnolinyl, benzoxazinyl, pteridinyl, quinolinyl, pyrrolyl, thiopenyl, pyranyl and furazanyl ring, $R_5$, $R_6$ and $R_7$ are independently an alkyl group of 1 to 12 atoms, or a cycloalkyl group of 5 to 12 carbon atoms in the ring structure, or any two adjacent groups chosen from $R_1$, $R_2$, $R_3$, and $R_4$, can represent the carbon, nitrogen, oxygen and sulfur atoms necessary to complete a 5- to 12-membered fused carbocyclic or heterocyclic ring structure connected to the primary nucleus of structure (I) or (II), said carbocyclic or heterocyclic ring structure being a pyridyl, pyrimidinyl, pyrazinyl, pyridizinyl, quinolinyl, quinoxalinyl, azonyl, thiazolyl, isopyrrolyl, pyrazolyl, imidazolyl, oxazolyl, isoxazolyl, oxadiazolyl, oxatriazolyl, dioxazolyl, triazinyl, oxazinyl, oxathiazinyl, diazepinyl, indolyl, isodinazolyl, quinolyl, isoquinolyl, indoxazinyl, quinazolinyl, pyridopyridyl, cinnolinyl, benzoxazinyl, pteridinyl, quinolinyl, pyrrolyl, thiopenyl, pyranyl, furazanyl, thiophenyl, furanyl, pyronyl, dioxinyl, oxazinyl, pyranyl, dioxazolyl or cyclohexenyl ring.

4. The method of claim 3 wherein said compound is selected from the group consisting of:

5,8-dihydroxy-4a-azoniaanthracene bromide (Compound 1), 5,6-dihydroxy-4a-azoniaanthracene bromide (Compound 2), N-(2,5-dihydroxyphenyl)pyridinium chloride (Compound 3), N-[methyl(2,5-dihydroxy-4-methylphenyl)]pyridinium chloride (Compound 4), N-[methyl(2,5-dihydroxy-4-methyl)]isoquinolinium chloride (Compound 5), N-[(methyl(2,5-dihydroxy-4-methyl)]quinolinium chloride (Compound 6), 2,5-dihydroxyphenyltrimethylammonium chloride (Compound 7).

5. The method of claim 1 wherein said solution has a pH of from about 1 to about 7.

6. The method of claim 1 wherein said nonbleaching solution further comprises at least about 0.0001 mol/l of a transition metal ion having an oxidation state of (II) or (III).

7. The method of claim 6 wherein said transition metal ion is copper(II), iron(II), iron(III), cobalt(II) or nickel(II).

8. The method of claim 7 wherein said transition metal ion is copper(II).

9. The method of claim 1 wherein said bleaching solution further comprises at least about 0.0001 mol/l of a transition metal ion having an oxidation state of (II) or (III).

10. The method of claim 1 wherein said bleaching solution comprises sodium persulfate as a bleaching agent.

11. The method of claim 1 wherein said bleaching solution further comprising a rehalogenating agent.

12. The method of claim 11 wherein said rehalogenating agent is chloride or bromide.

13. The method of of claim 1 wherein said cationic hydroquinone has a chemically reversible redox couple, versus a saturated calomel electrode, of from about −0.02 to about +1.0 volts.

14. The method of claim 1 wherein said cationic hydroquinone is 5,8-dihydro-4a-azoniaanthracene.

* * * * *